US007159346B1

(12) United States Patent
Wieringa

(10) Patent No.: US 7,159,346 B1
(45) Date of Patent: Jan. 9, 2007

(54) PORTABLE TOILET ADVERTISEMENT DISPLAY SYSTEM

(76) Inventor: Lawrence Wieringa, 221 Elsinore Rd., Riverside, CA (US) 92506

( * ) Notice: Subject to any disclaimer, the term of this patent is extended or adjusted under 35 U.S.C. 154(b) by 239 days.

(21) Appl. No.: 10/766,119

(22) Filed: Jan. 26, 2004

(51) Int. Cl.
*G09F 15/00* (2006.01)
*A47K 11/02* (2006.01)

(52) U.S. Cl. ..... 40/312; 4/449; 4/460

(58) Field of Classification Search ..... 40/312, 40/606.05, 606.03, 606.17, 611.08, 611.06, 40/611.13, 649; 220/908–910, 4.26, 4.27, 220/23.2, 23.83, 23.4; 4/449, 460, 462, 463
See application file for complete search history.

(56) References Cited

U.S. PATENT DOCUMENTS

| | | | | |
|---|---|---|---|---|
| 1,452,873 | A * | 4/1923 | Gifford | 40/606.05 |
| 3,005,277 | A * | 10/1961 | Sherron | 40/606.03 |
| 5,181,297 | A * | 1/1993 | Andrews et al. | 24/336 |
| 6,763,626 | B1 * | 7/2004 | Wieringa | 40/611.06 |
| 6,920,650 | B1 * | 7/2005 | Wieringa | 4/449 |

FOREIGN PATENT DOCUMENTS

DE 29921922 U1 * 4/2000

DE 10109626 A1 * 10/2002

OTHER PUBLICATIONS

PRO, Portable Restroom Operator Dec. 7, 2005 http://www.1promag.com/images/Covers/T.12.05.jpg.*

* cited by examiner

*Primary Examiner*—Cassandra Davis
(74) *Attorney, Agent, or Firm*—Goldstein Law Offices P.C.

(57) ABSTRACT

An advertisement display system, for use with a plurality of existing portable toilets arranged side-to-side with a gap between the toilets, for providing a substantially continuous advertising presentation. The system comprises a plurality of bracket assemblies each of which are selectively vertically attached along a corner of the toilet, and a plurality of substantially rectangular advertising panel assemblies which are selectively inserted between adjacent pairs of the bracket assemblies. The bracket assemblies include a plurality of intermediary bracket assemblies which are selectively mounted to the corners of the intermediary toilets in the series. A projecting portion of the intermediary bracket assembly extends beyond the side of the toilet to which it is attached. Accordingly, the advertising panel inserted into a vertical channel within the projecting portion also extends into the gap, thereby allowing the advertising display system to appear to be a single, continuous advertising panel.

14 Claims, 7 Drawing Sheets

PORTABLE TOILET ADVERTISEMENT DISPLAY SYSTEM

BACKGROUND OF THE INVENTION

1. Field of the Invention

The invention generally relates to a portable toilet advertisement display system, and in particular it relates to a portable toilet advertisement display system for use in conjunction with a plurality of existing portable toilets arranged in a side-to-side array, for allowing the toilets to be used to provide a substantially continuous advertising presentation.

2. Description of the Related Art

Portable toilets are frequently used during outdoor events, particularly ones which draw sizable numbers of people, such as concerts, plays, and sporting events. While portable toilets provide transitory restroom facilities to large numbers of people without the expense and commitment required to install water pipes and drainage pipes required for "fixed toilets", they have a number of disadvantages. In particular, portable toilets are generally visually unattractive, and detract from the aesthetic appeal of the environment in which they are situated. A variety of portable toilet advertisement display systems, comprising bracket assemblies and advertising panel assemblies for insertion between the brackets, have been devised for masking the walls of an existing portable toilet with advertising panel assemblies having printed sheets bearing an advertising message. These systems have the additional advantage of generating revenue from the advertisements for the owner of the portable toilets. However, these systems are limited in their ability to enhance the aesthetic appeal of a plurality of portable toilets arranged in a side-to-side array, having a gap between the individual toilets, and are useless for obscuring the gap between the toilets. Accordingly, there is a need for a portable toilet advertisement display system having a plurality of different bracket assemblies which are mountable onto corners of each of the toilets in the series, wherein the bracket attached to an intermediary toilet in the series has a projecting portion extending laterally beyond the side wall of the toilet and into the gap between the toilets. An advertising panel assembly fits within a vertical channel within the projecting portion, thereby allowing the advertising panel assembly to project into the gap, thereby providing a system which furnishes a substantially continuous advertisement, which is visually attractive as well as effective in conveying its particular advertising message.

A variety of portable toilet advertisement display systems have been devised. My prior U.S. Pat. No. 6,349,426 describes a portable toilet advertisement system which employs a cylindrical portable toilet housing which creates an effective advertising display upon what is otherwise "wasted space". Additionally, my prior U.S. Pat. No. D452, 901 illustrates a portable toilet which is cylindrical in shape, and which can easily accommodate an advertisement on a much more pleasing shape than the conventional rectangular portable toilet.

While these systems may be suitable for the particular purpose employed, or for general use, they would not be as suitable for the purposes of the present invention as disclosed hereafter.

SUMMARY OF THE INVENTION

It is an object of the invention to provide a portable toilet advertisement display system which enhances the appearance of a portable toilet housing. Accordingly, the present invention allows one or more panel assemblies to be attached to a portable toilet housing. The panels can bear an advertising message or simply a decorative image, and thereby enhances the appearance of the portable toilet housing.

It is another object of the invention to allow advertisement display on an existing, substantially rectangular, portable toilet housing. Accordingly, the present invention employs brackets which attach onto the existing portable toilet housing to allow the advertisement panel assemblies to be inserted therebetween.

It is yet another object of the invention to provide an effective advertisement display which may also be used in conjunction with a row of portable toilet housings, arranged in a side-to-side fashion, having a gap between the adjacent sides of the toilets. Accordingly, the system comprises a plurality of intermediary brackets having vertical channels which extend substantially into the gap, so that an advertising panel assembly selectively inserted therein will also extend substantially into the gap, thereby providing an advertising display system which, although comprised of a plurality of discrete advertising panels, appears to be a single, continuous advertising panel.

It is a further object of the invention to provide an advertisement display system that is attractive and highly visible. Accordingly, the brackets are preferably made of clear acrylic so as to minimize obscuring the edges of each advertising panel so that they together provide a continuous appearance.

The invention is an advertisement display system, for use in conjunction with a plurality of existing portable toilets arranged in a side-to-side array with a gap between the toilets, for allowing the toilets to be used to provide a substantially continuous advertising presentation. The system comprises a plurality of bracket assemblies each of which are selectively vertically attached along a corner of the toilet, and a plurality of substantially rectangular advertising panel assemblies which are selectively inserted between adjacent pairs of the bracket assemblies. The bracket assemblies include a plurality of intermediary bracket assemblies which are selectively mounted to the corners of the intermediary toilets in the series. A projecting portion of the intermediary bracket assembly extends beyond the side of the toilet to which it is attached. Accordingly, the advertising panel inserted into a vertical channel within the projecting portion also extends into the gap, thereby allowing the advertising display system to appear to be a single, continuous advertising panel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 7:
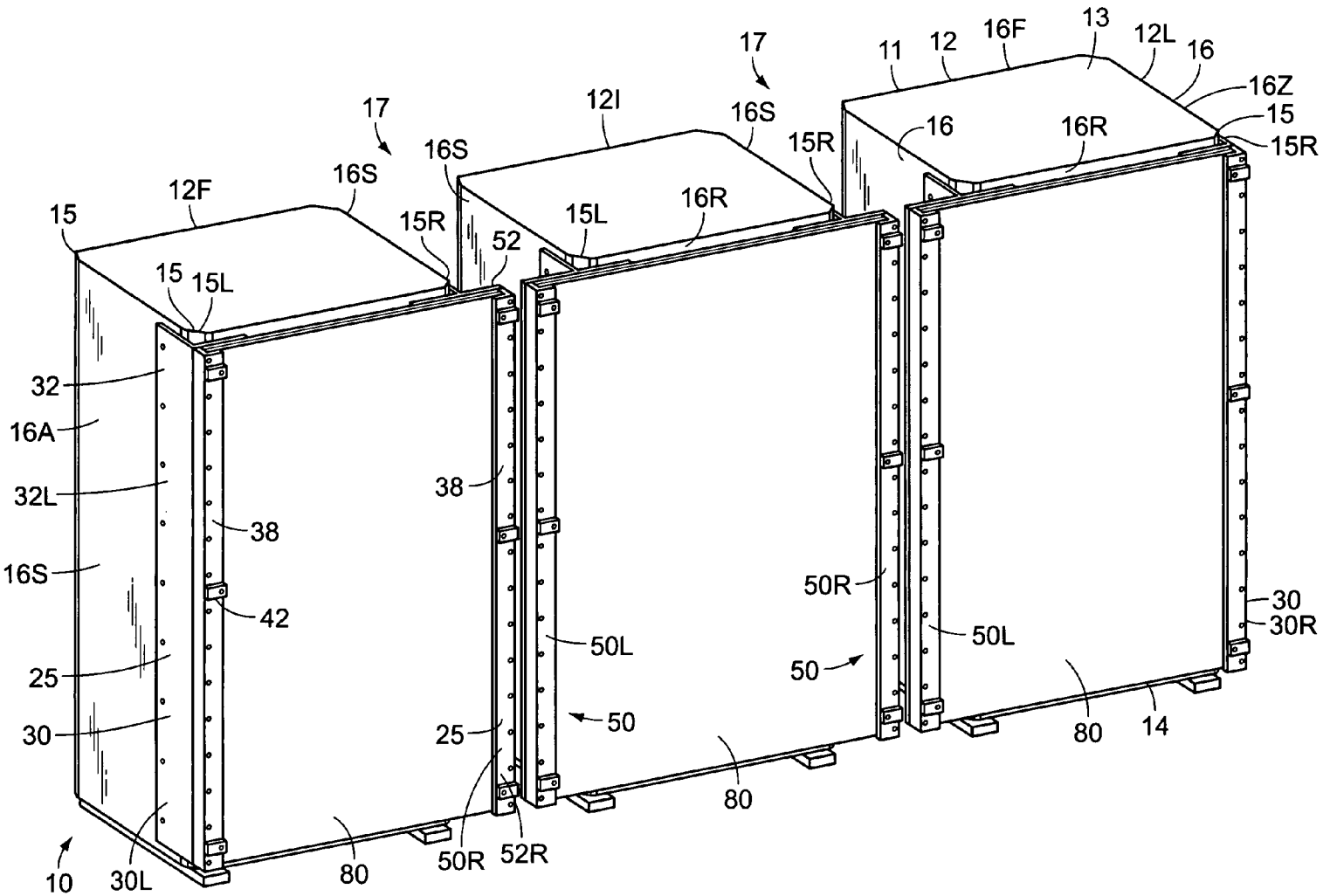
FIG. 7 is a perspective view of the system being used in conjunction with a row of toilet housings arranged in a side-to-side array and having a gap therebetween, wherein the gap is substantially bridged by the intermediary brackets.

FIG. 7 illustrates an advertisement display system 10 being used in conjunction with a plurality of existing portable toilets 11 having housings 12 arranged in a side-to-side array. The advertisement display system 10 comprises a plurality of different types of bracket assemblies 25, and a plurality of substantially rectangular advertising panel assemblies 80. The substantially rectangular toilet housings 12 each have an arcuate roof 13, a base 14, and four vertically extending walls 16, extending substantially between the base 14 and roof 13. The walls 16 include two side walls 16S, a rear wall 16R, and a front wall 16F. The front wall 16F has a door which selectively opens in order to allow a user to enter the toilet 11. The housings 12 each have four curved corners 15, each positioned between two adjacent walls 16, each corner 15 extending substantially from the base 14 to the roof 13. The corners 15 include a left rear corner 15L and a right rear corner 15R, when viewed from the rear of the housings 12. The housings 12 are separated from one another by a gap 17 of approximately four to six inches. The advertising panel assemblies 80 cover the rear walls 16R of the plurality of toilet housings 12, and additionally substantially extend into the gap 17 between the toilet housings 12, thereby providing a substantially continuous advertisement, as will be described.

The toilet housings 12 include a first toilet housing 12F, a last toilet housing 12L, and an intermediary toilet housing 12I. All of the side walls 16S of the housings 12 face onto an adjacent side wall 16S of an adjacent housing 12, with the exception of the first side wall 16A of the first housing 12F, and the last side wall 16Z of the last housing 12L. The bracket assemblies 25 include two types of bracket assemblies 25, namely, a terminal bracket assembly 30 and an intermediary bracket assembly 50. The terminal bracket assemblies 30 are selectively mounted to the corner 15 between the first side 16A and its rear wall 16R, and to the corner 15 between the last side 16Z and its rear wall 16R. The intermediary bracket assemblies 50 are selectively mounted to the corners 15 between all of the other sides 16S of the plurality of toilet housings 12 and their respective rear walls 16R. A plurality of each type of the bracket assemblies 25 is provided with the advertisement display system 10. Moreover, the terminal bracket assemblies 30 are provided as two mirror image bracket assemblies—a left terminal bracket assembly 30L which is selectively mounted onto the left rear corner 15L of the first toilet housing 12F, and a right terminal bracket assembly 30R which is selectively mounted onto the right rear corner 15R of the last toilet housing 12L. Analogously, the intermediate bracket assemblies 50 are provided as two mirror image bracket assemblies—a left intermediary bracket assembly 50L which is selectively mounted onto all the remaining left rear corners 15L of the toilet housings 12, and a right intermediary bracket assembly 50R which is selectively mounted onto all the remaining right rear corners 15R of the toilet housings 12.

Figure 3:
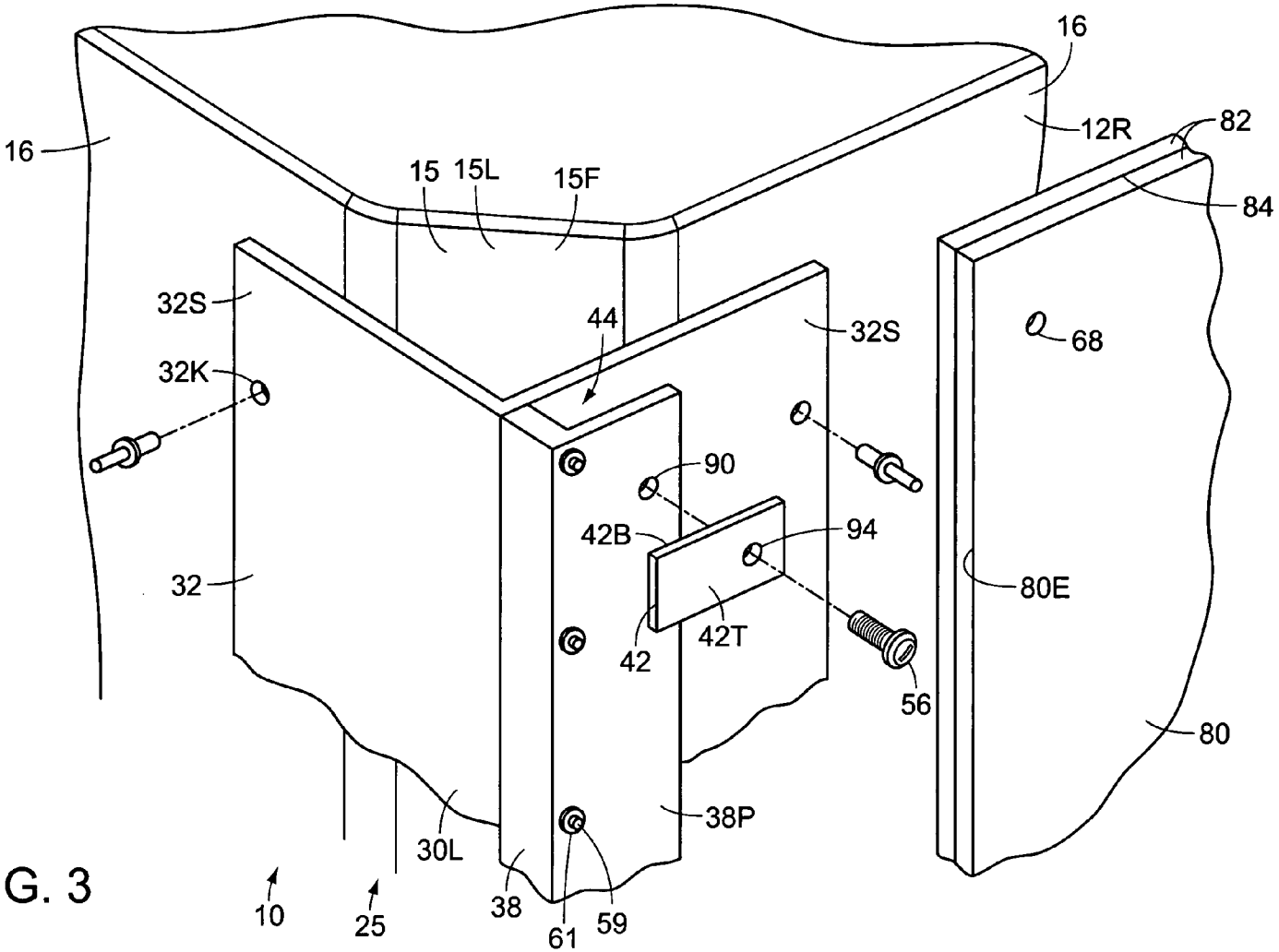
FIG. 3 is a perspective view of the terminal bracket being selectively mounted onto a corner of a portable toilet housing.
Figure 4:
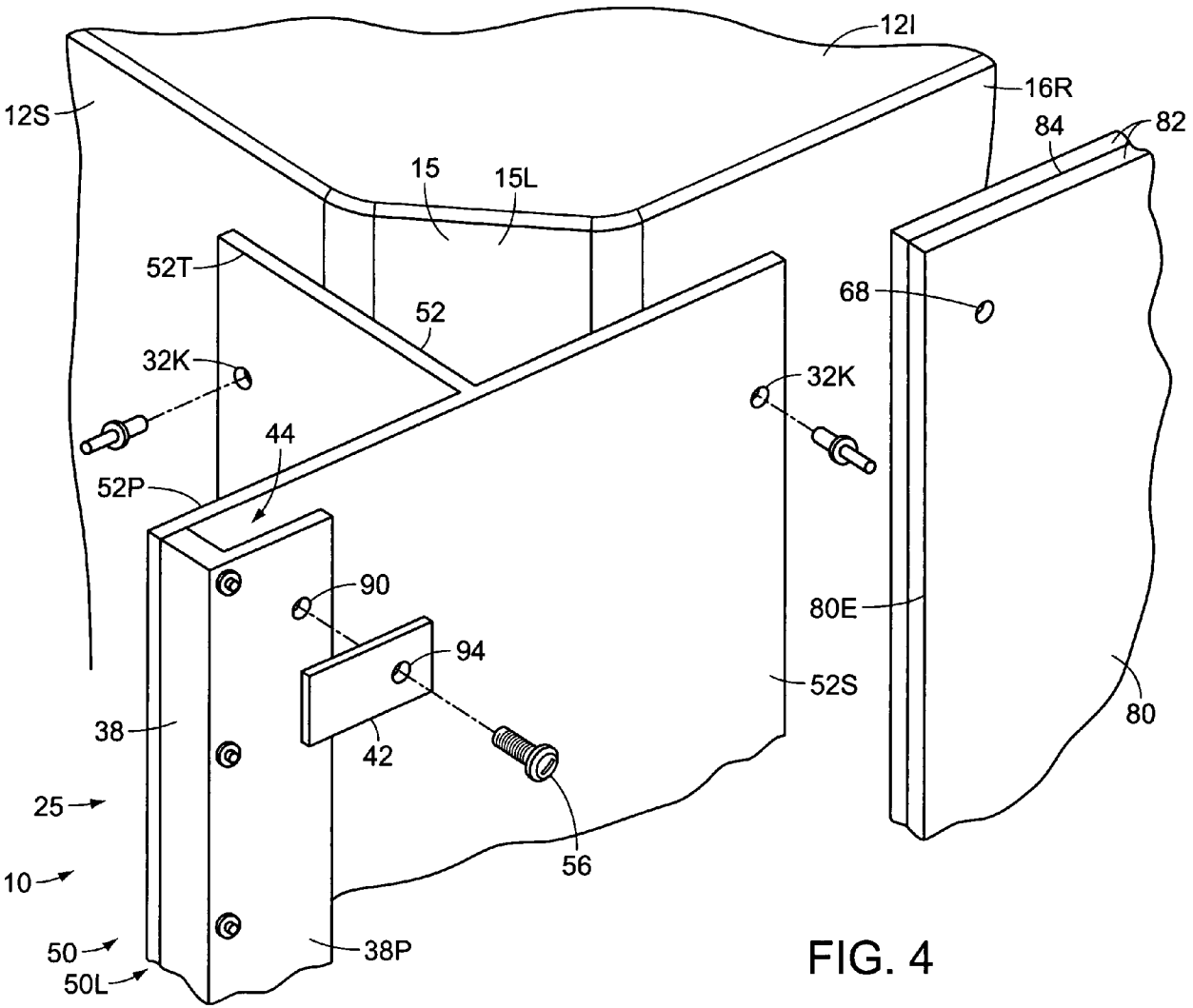
FIG. 4 is a perspective view of the intermediary bracket being selectively mounted onto a corner of the portable toilet housing.

Referring to FIG. 7, each advertising panel assembly 80 is substantially rectangular, and has two vertical edges 80E. Referring to FIGS. 3 and 4, each advertising panel assembly 80 comprises two substantially transparent, flexible outer panels 82, and a substantially rectangular printed sheet 84 extending therebetween. Generally, the printed sheet 84 is interchanged as desired, and the outer panels 82 provide support and protection for the printed sheet 84. The printed sheet 84 is generally thin, and can be double-sided, with different advertisements on each side, in order that the advertising panel assembly 80 can be selectively "turned around", in order to display one or the other side of the printed sheet 84. The printed sheet 84 can bear an advertisement, or can be printed with a purely decorative image, so as to enhance the appearance of the portable toilet housing 12. The printed sheets 84 are designed and printed using conventional graphics techniques.

An advertising panel assembly 80 extends between the left terminal bracket assembly 30L mounted onto the left rear corner 15L, and the right intermediary bracket assembly 50R mounted onto the right rear corner 15R of the first toilet housing 12F. An advertising panel assembly 80 extends between the left intermediary bracket assembly 50L mounted onto the left rear corner 15L, and the right intermediary bracket assembly 50R mounted onto the right rear corner 15R of all the intermediary toilet housings 12I. Finally, an advertising panel assembly 80 extends between the left intermediate bracket assembly 50L mounted onto the left rear corner 15L, and the right terminal bracket assembly 30R mounted onto the right rear corner 15R, of the last toilet housing 12L of the series of housings 12.

Turning to FIG. 3 and FIG. 4, each bracket assembly 25 includes either a terminal bracket 32 or an intermediary bracket 52, for engaging a corner 15 of the housing 12. Each bracket assembly 25 further includes an L-bracket 38 extending from the bracket 32 or 52, for engaging a vertical edge 80E of one of the plurality of panel assemblies 80, and three attachment plates 42 for rigidly anchoring the panel assembly 80 to the bracket assemblies 25. Each of the L-brackets 38 is substantially identical. Each of the attachment plates 42 is substantially identical. Accordingly, a description of the L-bracket 38 and one of the attachment plates 42 of the left terminal bracket assembly 30L will suffice as a description of the L-bracket 38 and the attachment plates 42 of each of the other bracket assemblies 25. A detailed description of the left terminal bracket assembly 30L is followed by a detailed description of the intermediate bracket 52 of the left intermediate bracket assembly 50L.

Figure 1:
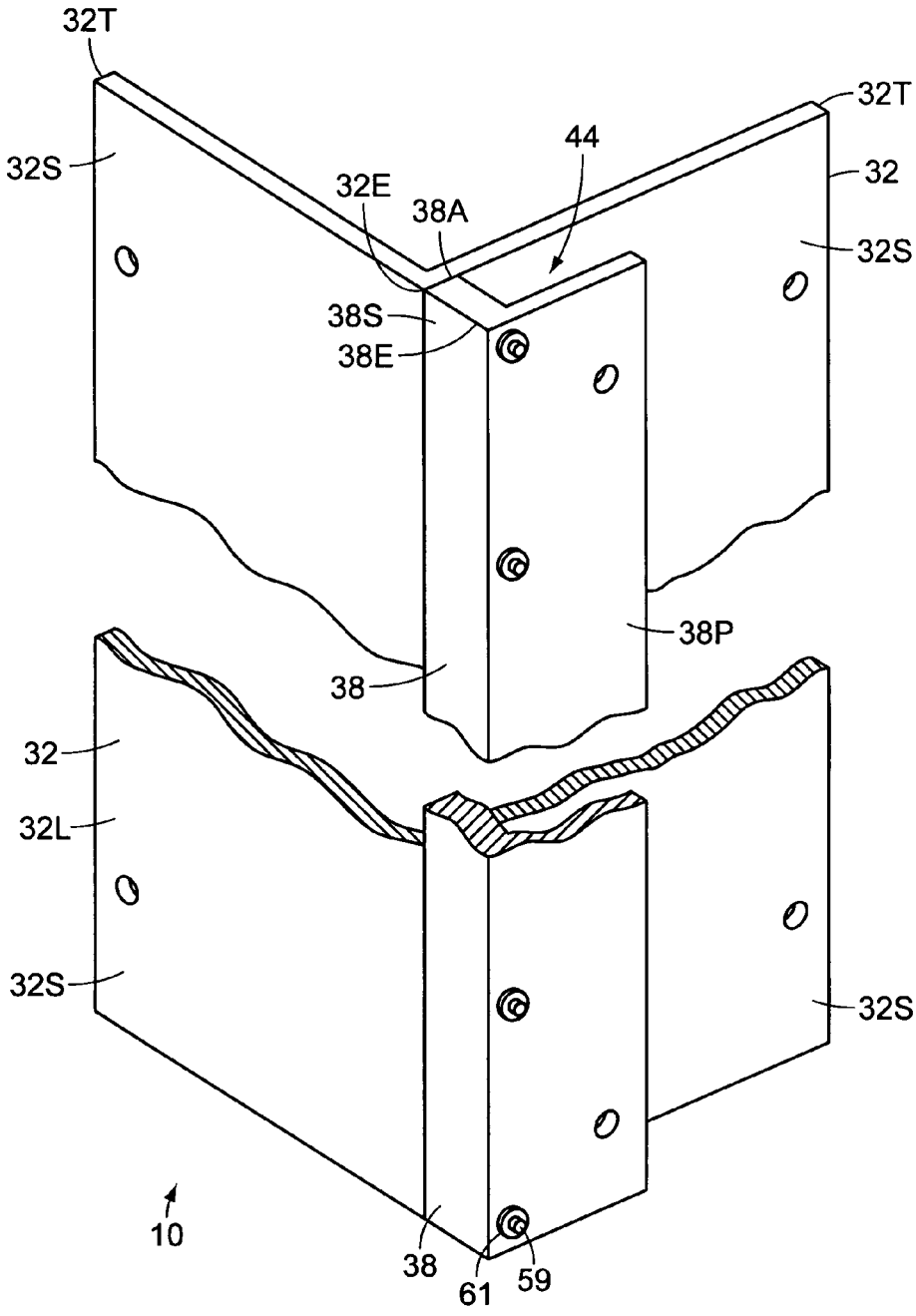
FIG. 1 is a perspective view of a terminal bracket.

FIG. 1 illustrates a terminal bracket 32 of the terminal bracket assembly 30 illustrated in FIG. 3. More particularly, FIG. 1 illustrates a left terminal bracket 32L, for selective attachment to the left rear corner 15L of the first housing 12F in the series. The left terminal bracket 32L has two sides 32S extending perpendicularly from a common edge 32E. Each side 32S terminates in a terminal edge 32T. Each of the sides 32S has a length which extends from a little above the base 14 of the portable toilet housing 12 substantially to the roof 13 of the portable toilet housing 12, so that when an advertising panel assembly 80 is extended between any two adjacent brackets, 32 and 52, or 52 and 52, it will substantially conceal the wall 16 of the toilet housing 12 which extends between the corners 15 to which the brackets, 32 or 52, have been selectively attached, thereby disguising the toilet 11 in order that it appears to be simply an advertisement. Each of the sides 32S of the terminal bracket 32 has a width which is substantial enough to allow the sides 32S to be selectively attached to the flat portions of the side walls 16S of an existing toilet housing 12 regardless of whether the corners 15 of the housing 12 are curved or right-angled. In this regard, referring to FIG. 3, each of the sides 32S of the terminal bracket 32 has an attachment opening 32K extending fully therethrough. After pressing the sides 32S of the terminal bracket 32 flush against the portion of the walls 16 which extend from the corner 15F, the sides 32S are rigidly secured to the walls 16 by extending a fastener such as a rivet through each of the attachment openings 32K.

Returning to FIG. 1, one of the sides 32S of the terminal bracket 32 has an elongated, transparent L-bracket 38 extending perpendicularly outward from, in proximity to the common edge 32E between the sides 32S. The L-bracket 38 comprises a common edge 38E, and a first side 38S and a second side 38P extending perpendicularly therefrom. The side 38S has a rectangular attachment edge 38A. The attachment edge 38A is rigidly affixed to the side 32S of the terminal bracket 32 in proximity to the edge of 32E of the terminal bracket 32. The second side 38P extends partially rightward, and at a right angle, towards the terminal edge 32T of the side 32S from which the L-bracket 38 extends, thereby forming a vertical channel 44 between the L-bracket 38 and the side 32S of the terminal bracket 32. Returning momentarily to FIG. 3, the channel 44 provides sufficient clearance for one of the vertical edges 80E of the advertising panel assemblies 80 to extend therein.

The L-bracket 38 extends the entire length of the terminal bracket 32. The L-bracket 38 may be attached to the terminal bracket 32 by a variety of fasteners, including rivets. Returning to FIG. 7, after mounting the left terminal bracket 32L to the left rear corner 15L of the toilet housing 12, and mounting a right intermediate bracket 52R to the right rear corner 15R of the same toilet housing 12, the vertical channels 44 of the two L-brackets 38 face one another. In order to attach an advertising panel assembly 80 between the two brackets, 32L and 52R, the panel assembly 80 is slightly flexed by pushing the vertical edges 80E partially towards one another, one of the vertical edges 80E of the advertising panel assembly 80 is selectively extended into the channel 44 within the left terminal bracket 32L, and the other vertical edge 80E of the advertising panel assembly 80 is selectively extended into the channel 44 within the right intermediary bracket 52R. The advertising panel assembly 80 is rigidly secured to the brackets 32L and 52R by the use of six attachment plates 42, as will be described.

FIG. 3 and FIG. 4 detail the attachment plates 42. In particular, the attachment plates 42 each have a top surface 42T and a bottom surface 42B. The attachment plates 42 each have a securing hole 94. The L-bracket 38 has a securing bore 90 extending through the side 38P of the L-bracket 38. When the securing hole 94 of the attachment plate 42 is aligned with the securing bore 90 of the L-bracket 38, the securing hole 94 and the securing bore 90 are concentric.

Returning to FIG. 7, the L-brackets 38 extending from the terminal brackets 32 and the intermediary brackets 52 each have three substantially rectangular attachment plates 42 attached thereunto. In particular, one of the attachment plates 42 is located at the top of each of the L-brackets 38, one of the attachment plates 42 is located at the bottom of each of the L-brackets 38, and one of the attachment plates 42 is located substantially midway between the top and the bottom of each of the L-brackets 38. Returning to FIG. 3, each attachment plate 42 has one advertising panel retainer screw 56. The panel assemblies 80 have guide holes 68 extending fully therethrough along the vertical edges 80E. The guide holes 68 are spaced according to the positioning of the attachment plates 42 so as to allow one of the retainer screws 56 from each of the attachment plates 42 to extend through one of the guide holes 68. Accordingly, preferably three guide holes 68 are located along each of the vertical edges 80E so as to mate with the retainer screws 56 extending through the attachment plates 42 and the L-brackets 38. The advertising panel assemblies 80 are held in place within the channels 44 of the terminal bracket 32 by the retainer screws 56 which extend through the attachment plates 42, through the L-brackets 38, through the guide holes 68 in the advertising panel assemblies 80, and against one of the sides 32S of the terminal bracket 32. The retainer screws 56 each have a head and a point. When fully tightened, the head of each retainer screw 56 extends flush against one of the attachment plates 42 and the point abuts one of the sides 32S of the terminal bracket 32. Accordingly, the advertising panel assemblies 80 are secured in place between the L-bracket 38 and the terminal bracket 32. The retainer screws 56 are sized to pass through the securing bores 90 in the L-bracket 38, the guide hole 68 in the outer panels 82, and finally the point of the screw 56 will abut one of the sides 32S of the terminal bracket 32, thereby securing the panel assemblies 80 in place. It is contemplated that the securing hole 94 within the attachment plate 42 may be threaded, in order to engage the threads on the retainer screw 56. Additionally, the securing bores 90 extending through the L-brackets 38, and/or the guide holes 68 extending through the panel assemblies 80 may be threaded, in order to engage the threads on the retainer screw 56.

The system 10 is provided with a plurality of secondary fasteners 59 which extend through the L-brackets 38 through secondary holes 61 therein, for further securing the L-bracket 38 to the terminal bracket 32. The fasteners 59 may be a rivet or a threaded screw.

Figure 5:
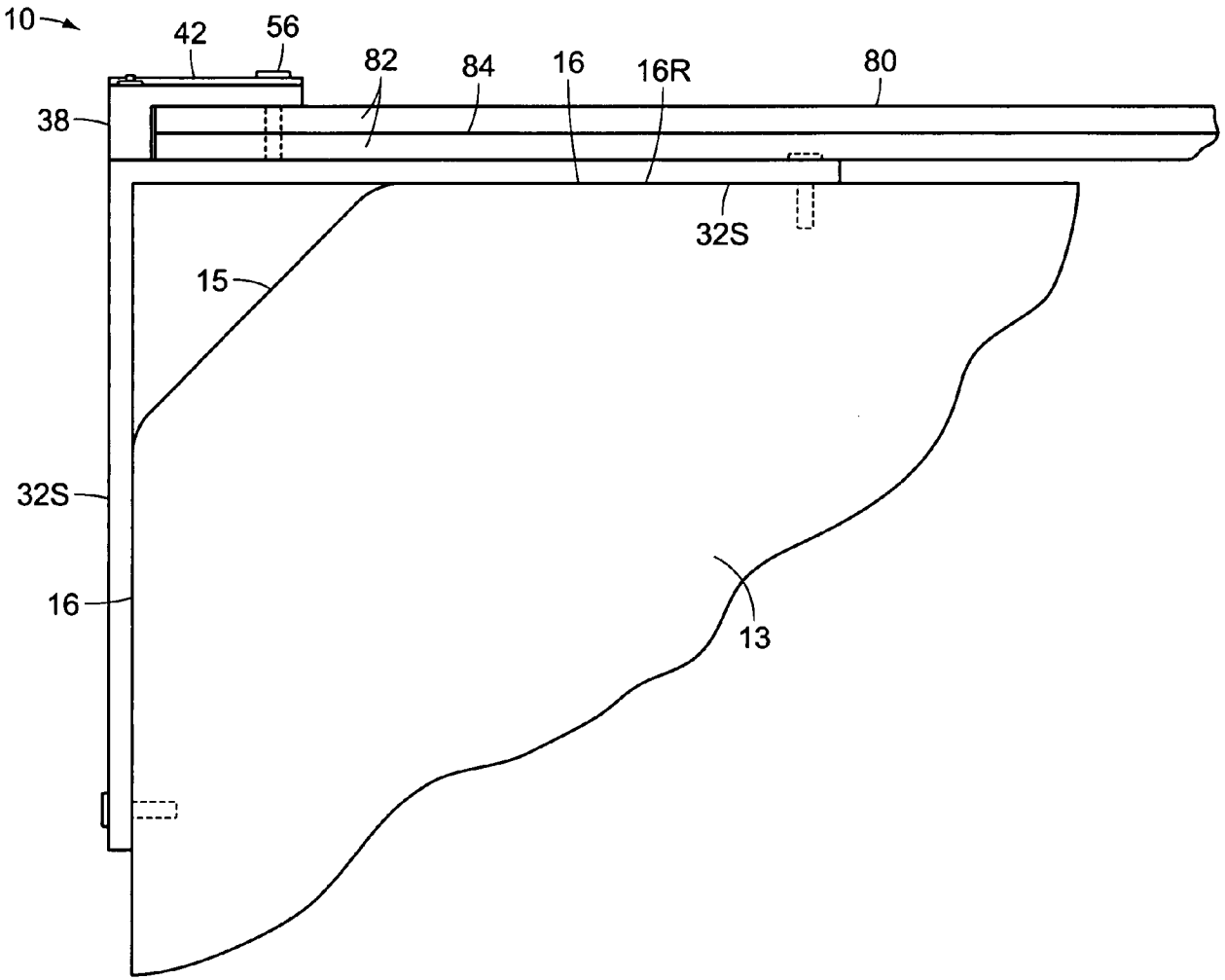
FIG. 5 is a top elevational view of the terminal bracket after selective attachment to a corner of the portable toilet housing.

FIG. 3 illustrates the terminal bracket 32 positioned for selective attachment to the left rear corner 15L of the first toilet housing 12F in the series. FIG. 5 illustrates a top elevational view of the terminal bracket 32 after selective attachment to one of the corners 15 of the portable toilet housing 12.

Figure 2:
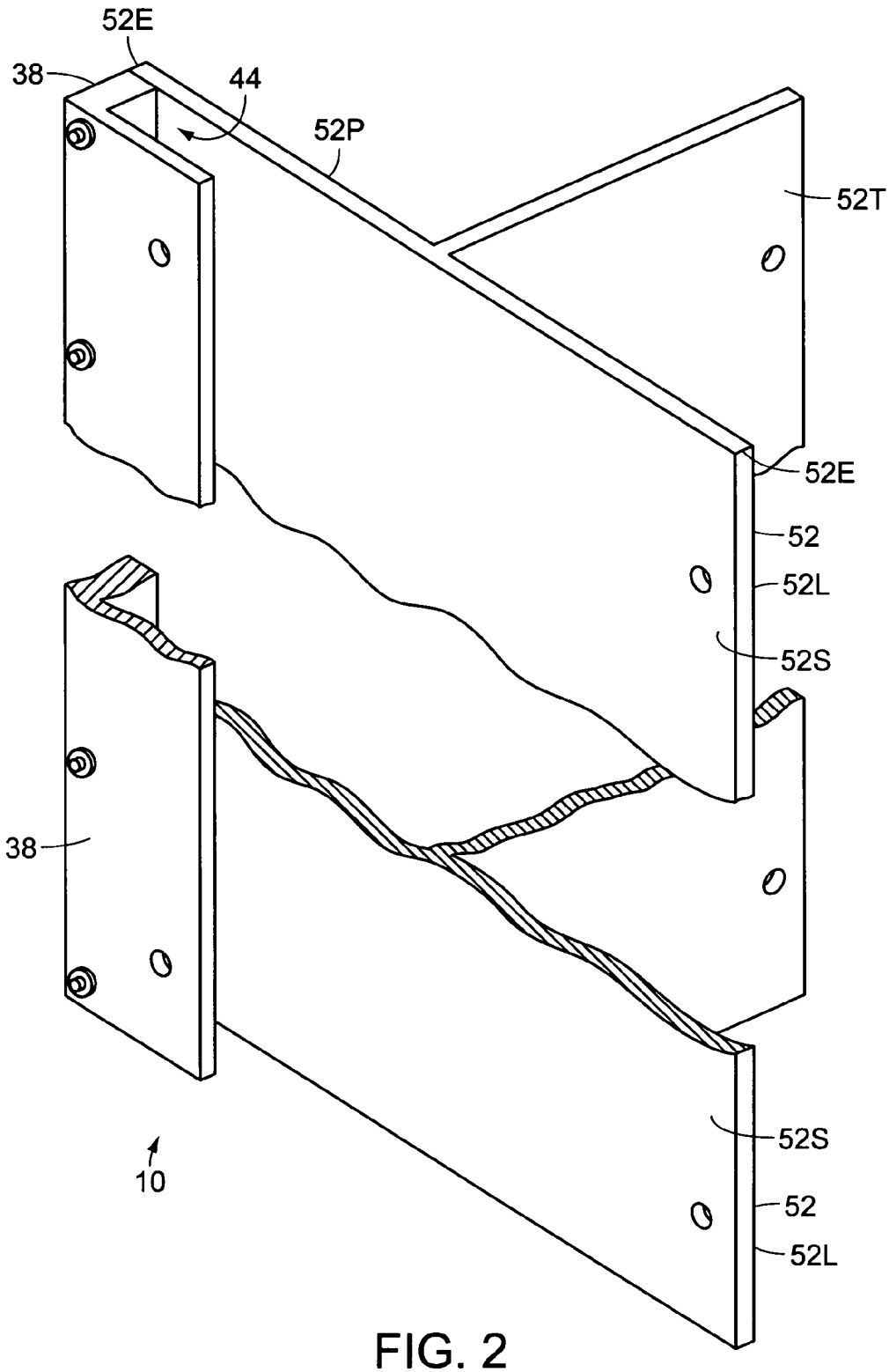
FIG. 2 is a perspective view of an intermediary bracket.

Turning to FIG. 2, the intermediary bracket assembly 50 comprises a "T-shaped" intermediary bracket 52 having a first side 52S and a second side 52T, the first side 52S having two vertical edges 52E, and the second side 52T extending perpendicularly from the first side 52S at a position between the two vertical edges 52E of the first side 52S, in the manner of a "T". FIG. 2 particularly illustrates a left intermediary bracket 52L, for selective attachment to a left rear corner 15L of an intermediary toilet housing 12I.

After being mounted to a left rear corner 15L, the intermediary bracket 52 has a straight projecting portion 52P which extends from the first side 52S beyond the side wall 16S of the toilet housing 12 to which it is attached, and into the gap 17 between said toilet housing 12 and the adjacent toilet housing 12. The projecting portion 52P has an L-bracket 38 extending perpendicularly outward therefrom, in proximity to its edge 52E. The L-bracket 38 is substantially identical to the L-bracket 38 used with the terminal bracket 32. A vertical channel 44 is formed between the first side 52S of the intermediary bracket 52 and the L-bracket 38 extending therefrom. The channel 44 is used to selectively engage one of the vertical edges 80E of a panel assembly 80.

The attachment plates 42 used with the intermediary bracket assemblies 50 are substantially identical to the attachment plates 42 used with the terminal bracket assemblies 30. Moreover, the L-brackets 38 used in the intermediary bracket assemblies 50 are substantially identical to the L-brackets 38 used with the terminal bracket assemblies 30. Accordingly, no further discussion of either the attachment plates 42 or the L-brackets 38 is warranted.

Turning to FIG. 4, the intermediary bracket assemblies 50 are selectively attached to the side walls 16S of the intermediary toilet housings 12I in the series of portable toilet housings 12. As illustrated in FIG. 7, because the projecting portion 52P of the intermediary bracket 52 extends laterally beyond the rear wall 16R of the housing 12 to which it is attached, the panel assembly 80 selectively fitted within the channel 44 also extends laterally beyond the rear wall 16R of the housing 12 to which it is attached, thereby furnishing a system 10 which appears substantially continuous between all of the rear walls 16R of the toilet housings 12. When used with a plurality of the portable toilet housings 12 lined up in a side-to-side array, the panel assemblies 80 cover the rear wall 16R of each housing 12, and additionally, in conjunction with one another, substantially obscure the gaps 17 between the toilet housings 12, in order to furnish a more aesthetically pleasing and effective system 10.

Figure 6:
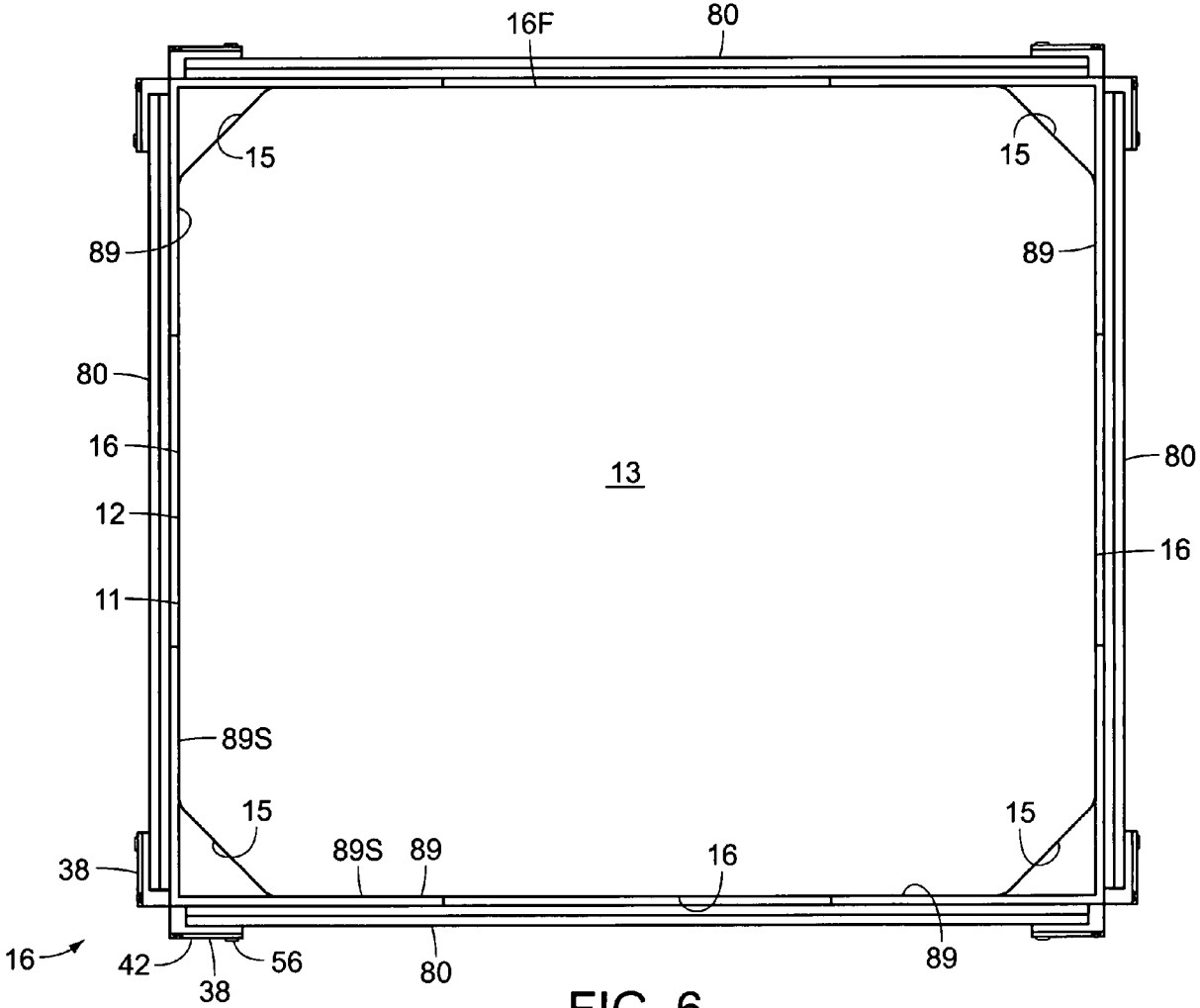
FIG. 6 is a top elevational view wherein four modified terminal brackets have been selective attached to the four corners of a solitary toilet housing, in order to cover more than one wall of the housing with an advertisement.

FIG. 6 illustrates the system 10 being used in conjunction with a solitary portable toilet 11 having a housing 12. The system 10 additionally comprises a plurality of modified terminal brackets 89 having two sides 89S as in the aforementioned terminal brackets 32, and additionally having an L-bracket 38 extending perpendicularly from each of the sides 89S of the modified terminal bracket 89. One of the modified terminal brackets 89 has been attached to each of the four corners 15 of the portable toilet housing 12. The toilet 11 is not being used as a toilet. Accordingly, four of the panel assemblies 80 are installed across all of the walls 16 to create a four-sided advertising presentation upon the portable toilet housing 12. If the toilet 11 is being used as a toilet, the panel assembly 80 which covers the front wall 16F and the door may be removed create a three-sided advertising presentation.

The brackets 32 and 52, and the L-brackets 38 extending perpendicularly therefrom, may be constructed from a variety of materials, including aluminum, and are preferably constructed from a transparent acrylic material, so that they do not obscure the view of the vertical edges 80E of the advertising panels 80. The attachment plates 42 are preferably constructed from a more durable material, such as aluminum, in order to withstand the stress involved with the repeated tightening and un-tightening of the retainer screws 56. The attachment plates 42 enhance the longevity of the terminal brackets 32, the intermediary brackets 52, and the L-brackets 38 extending therefrom, and thus minimize maintenance for the advertising display system 10.

Preferably, the outer panels 82 of the panel assemblies 80 are made of flexible clear polycarbonate sheets. The outer panels 82 must be flexible enough to allow them to slightly flex while being fitted between two vertical channels 44 of adjacent bracket assemblies 25, yet rigid enough to withstand years of exposure to the elements. Most standard portable toilets have walls which are substantially three and a half feet wide and seven feet tall. Accordingly, it is preferable that the advertising panel assemblies 80 are approximately three and a half feet wide and seven feet tall. However, the size of the advertising panel assembly 80 can be varied according to the portable toilet 11 it is to be used with and the desired effect.

When used in conjunction with a plurality of toilet housings 12 arranged in a side-to-side array, with a gap 17 between any two adjacent toilet housings 12, the printed sheets 84 can be configured so that each represents a vertical slice of one continuous image. Each sheet 84 can be installed on an adjacent portable toilet housing 12. For example, said sheets 84 can be installed on the rear walls 16R of several portable toilet housings 12, and those housing 12 can be placed immediately adjacent each other to create a continuous mural.

In conclusion, herein is presented an advertising display system for use in conjunction with a plurality of existing portable toilets arranged in a side-to-side array, for enhancing the appearance of the portable toilets, and for allowing the toilets to be used to provide a substantially continuous advertising presentation. The invention is illustrated by example in the accompanying drawing figures and the foregoing description. Numerous variations are possible, however, while adhering to the inventive concept. Such variations are contemplated as being a part of the present invention.

What is claimed is:

1. An advertisement display system, for use in conjunction with a plurality of existing portable toilets having housings arranged in a side-to-side array, for allowing the toilets to be used to provide a substantially continuous advertising presentation, said housings each having a roof, a base, and four vertically extending walls, said walls including two side walls, a rear wall, and a front wall having a door which selectively opens, said housings each having four corners, including a left rear corner and a right rear corner, wherein the sides of adjacent housings are separated from one another by a gap, wherein the housings include a first housing having a first side, a last housing having a last side, and a plurality of intermediary housings, comprising:

a plurality of terminal bracket assemblies for vertical mounting at the corner between the first side of the first housing and its rear wall, and at the corner between the last side of the last housing and its rear wall, wherein each terminal bracket assembly is provided as two mirror image bracket assemblies—a left terminal bracket assembly which is selectively mounted onto the left rear corner of the first toilet housing, and a right terminal bracket assembly which is selectively mounted onto the right rear corner of the last toilet housing;

a plurality of intermediary bracket assemblies for vertical mounting at the corners between all of the other sides of the plurality of toilet housings and their respective rear walls, wherein each intermediate bracket assembly is provided as two mirror image bracket assemblies—a left intermediary bracket assembly which is selectively mounted onto all the remaining left rear corners of the toilet housings, and a right intermediary bracket assembly which is selectively mounted onto all the remaining right rear corners of the toilet housings, each intermediary bracket assembly comprises a T-shaped intermediary bracket having a straight, projecting portion, wherein after being mounted to a rear corner, the straight projecting portion extends laterally beyond the side wall of the toilet housing to which it is attached, and into the gap between said toilet housing and the adjacent toilet housing, wherein the projecting portion has an L-bracket extending perpendicularly outward therefrom, wherein a vertical channel is formed between the projecting portion of the intermediary bracket and the L-bracket extending therefrom, said channel for selectively engaging one of the vertical edges of a panel assembly, wherein the channel also extends laterally beyond the rear wall of the housing to which the bracket assembly is attached;

a plurality of advertising panel assemblies, for covering the rear walls of the plurality of toilet housings, and additionally for substantially extending into the gaps between the toilet housings in order to provide a substantially continuous advertisement, each advertising panel assembly having two vertical edges and a printed sheet which is interchanged as desired; and wherein one of the advertising panel assemblies selectively extends between the terminal bracket assembly mounted onto the left rear corner and the intermediary bracket assembly mounted onto the right rear corner of the first toilet housing, wherein at least another one of the advertising panel assemblies selectively extends between the intermediary bracket assembly mounted onto the left rear corner and the intermediary bracket assembly mounted onto the right rear corner of all the intermediary toilet housings, and wherein one of the advertising panel assemblies selectively extends between the intermediary bracket assembly mounted onto the left rear corner and the terminal bracket assembly mounted onto the right rear corner of the last toilet housing in the series of housings.

2. The advertisement display system as recited in claim 1, wherein each of the terminal bracket assemblies comprises a terminal bracket, having two sides extending perpendicularly from a common edge, for engaging a corner of the housing, wherein one of the sides has an elongated L-bracket extending perpendicularly outward therefrom, in proximity to the common edge, thereby forming a vertical channel between the L-bracket and the side of the terminal bracket from which it extends, for selectively engaging one of the vertical edges of the advertising panel assemblies.

3. The advertisement display system as recited in claim 2, wherein the system additionally comprises a plurality of modified terminal brackets having two sides as in the aforementioned terminal brackets, and additionally having an L-bracket extending perpendicularly from each of the sides of the modified terminal bracket, in order that the system may be used in conjunction with a solitary portable toilet housing, wherein one of the modified terminal brackets is selectively attached to each of the four corners of the solitary portable toilet housing, wherein three of the panel assemblies are installed across the walls which do not have the door to create a three-sided advertising presentation, and wherein a fourth panel assembly may be installed across the front wall having the door, to create a four-sided advertising presentation upon the portable toilet housing, if the toilet is not being used as a toilet.

4. The advertisement display system as recited in claim 3, wherein each advertising panel assembly comprises two substantially transparent, flexible outer panels for providing support and protection for the printed sheet.

5. The advertisement display system as recited in claim 4, wherein the terminal brackets and the intermediary brackets each extend from a little above the base of the portable toilet housing substantially to the roof of the portable toilet housing, after selective attachment to the toilet housing.

6. The advertisement display system as recited in claim 5, wherein each of the L-brackets extends substantially the entire length of the bracket onto which it has been selectively attached.

7. The advertisement display system as recited in claim 6, wherein the L-brackets which extend from the terminal brackets and the intermediary brackets each have three attachment plates selectively attached thereunto, for rigidly anchoring the panel assembly to the bracket assemblies, wherein one of the attachment plates is located at the top of each of the L-brackets, one of the attachment plates is located at the bottom of each of the L-brackets, and one of the attachment plates is located substantially midway between the top and the bottom of each of the L-brackets.

8. The advertisement display system as recited in claim 7, wherein the attachment plates each have at least one securing hole extending therethrough, wherein the L-bracket has at least one securing bore extending therethrough, wherein each attachment plate has one advertising panel retainer screw, wherein the panel assemblies have guide holes extending fully therethrough along the vertical edges, wherein the guide holes are spaced according to the positioning of the attachment plates so as to allow one of the retainer screws from each of the attachment plates to extend through one of the guide holes, wherein the advertising panel assemblies are held in place within the channels of the bracket assemblies by the retainer screws which extend through the at least one securing hole in the attachment plates, through the at least one securing bore in the L-brackets, through the guide holes in the advertising panel assemblies, and against one of the sides of the bracket from which the L-bracket extends.

9. The advertisement display system as recited in claim 8, wherein the printed sheet is double-sided, and has different advertisements on each side.

10. The advertisement display system as recited in claim 9, wherein the printed sheets are configured so that each represents a vertical slice of one continuous image, and wherein each sheet can be installed on an adjacent portable toilet housing to create a continuous mural effect.

11. The advertisement display system as recited in claim 10, wherein each of the sides of the brackets which are mounted to the walls of the housings has at least one attachment opening extending fully therethrough, wherein after pressing each of said sides of the brackets flush against the portion of the walls which extend from the corner, each of said sides is rigidly secured to a wall by extending a fastener through the attachment opening and into one of the walls of the housing.

12. The advertisement display system as recited in claim 11, wherein the terminal brackets and the intermediary brackets, and the L-brackets extending perpendicularly from each, are constructed from a transparent acrylic material, so that they do not obscure the view of the advertising panels.

13. The advertisement display system as recited in claim 12, wherein the outer panels of the panel assemblies are made of flexible, clear, polycarbonate sheets.

14. The advertisement display system as recited in claim 13, wherein the attachment plates are constructed from aluminum.

* * * * *